United States Patent [19]

Hosoya et al.

[11] Patent Number: 5,038,178

[45] Date of Patent: Aug. 6, 1991

[54] IMAGE TRANSFER MEMBER INCLUDING AN ELECTROCONDUCTIVE LAYER

[75] Inventors: Masahiro Hosoya, Yokohama; Mitsunaga Saito, Tokyo; Shuitsu Sato, Kawasaki, all of Japan

[73] Assignee: Kabushiki Kaisha Toshiba, Kanagawa, Japan

[21] Appl. No.: 258,429

[22] Filed: Oct. 17, 1988

[30] Foreign Application Priority Data

Oct. 20, 1987 [JP] Japan ..... 62-264657

[51] Int. Cl.[5] ..... G03G 15/14; G03G 15/16

[52] U.S. Cl. ..... 355/277; 355/271

[58] Field of Search ..... 355/271, 277, 273, 276

[56] References Cited

U.S. PATENT DOCUMENTS

| | | | |
|---|---|---|---|
| 3,702,482 | 11/1972 | Dolcimdscolo et al. | 355/271 X |
| 3,993,021 | 11/1976 | Kline | 355/271 X |
| 4,063,808 | 12/1977 | Simpson | 355/274 |
| 4,087,169 | 5/1978 | Fantuzzo | 355/277 |
| 4,309,803 | 1/1982 | Blaszak | 355/271 X |
| 4,496,233 | 1/1985 | Gage et al. | 355/277 X |
| 4,527,169 | 7/1989 | Springer | 346/74.2 |

FOREIGN PATENT DOCUMENTS

| | | | |
|---|---|---|---|
| 2653899 | 11/1976 | Fed. Rep. of Germany . | |
| 54-1638 | 1/1979 | Japan | 355/277 |
| 54-19750 | 2/1979 | Japan . | |
| 54-19752 | 2/1979 | Japan . | |
| 55-18653 | 2/1980 | Japan . | |

*Primary Examiner*—Fred L. Braun

*Attorney, Agent, or Firm*—Finnegan, Henderson, Farabow, Garrett and Dunner

[57] ABSTRACT

A transfer device for transferring a toner image on an image carrier onto a transfer material, including a transfer drum, a supporting device for the transfer material in place on the surface of the transfer drum and an electrode for applying a bias voltage to an electroconductive layer of the transfer drum. The transfer drum includes a rotatably supported drum member, a flexible elastomer layer on the peripheral surface of the drum member, and an electroconductive layer on the elastomer layer. The elastomer layer of the transfer drum is made of a foaming elastomer such as a polyurethane foam so that the transfer material is in contact with the toner image on the image carrier under a small amount of pressure and with an ample contact width.

21 Claims, 3 Drawing Sheets

IMAGE TRANSFER MEMBER INCLUDING AN ELECTROCONDUCTIVE LAYER

The present application claims priority of Japanese Patent Application No. 62-264657 filed on Oct. 20, 1987.

FIELD OF THE INVENTION AND RELATED ART STATEMENT

The present invention relates to a transfer device such as an electrophotographic device or an electrographic device that transfers a toner image formed on an image carrier onto a transfer material.

The transfer device using a bias roller made of electro-conductive rubber has been finding utility as one way of working the electrostatic transfer method. This device, however, has posed the following problem.

To ensure production of transfer images enjoying high efficiency of transfer and good uniformity of transfer, the transfer device is required to establish a large contact width between a transfer roller and a sensitive drum and to press the transfer roller against the sensitive drum with a considerable amount of strength. As a result, in the central part of an image of high density, the pressed transfer drum squeezes part of the toner of the image against the sensitive drum, often resulting in the affected part of the image in the electric field of transfer not being transferred, and the transferred image suffering from the so-called partial loss of image phenomenon. Particularly in the color recording device which effects multiple transfer of toners of different colors on one and the same transfer paper, since the transfer must be wrapped around the peripheral surface of the transfer roller (or transfer drum), the transfer roller is required to possess a large outside diameter. To absorb irregularities and protuberances and depressions in the electro-conductive rubber surface and product uniform transfer images, it has been necessary for the transfer roller to be pressed under the pressure in the range of 500 to 2,000 kg/cm$^2$. Under the pressure of this magnitude, it has been difficult to preclude the aforementioned phenomenon of partial loss of image.

The transfer device disclosed as in the specification of Japanese Patent Application Disclosure SHO54(1979)-19750 uses a transfer drum which comprises a partially cleaved drum and an electro-conductive sheet stretched across the cleavage in the drum and which permits a reduction in the aforementioned powerful pressing. In this case, however, since the electrostatic force of adsorption exerted between the electro-conductive sheet and the sensitive drum is weak, the contact width established between the transfer paper and the sensitive drum is too narrow to obtain highly efficient transfer. Further, the warp suffered to occur in the electro-conductive sheet possibly produces inferior contact between the opposed surfaces and induces partial omission of transfer.

When an insulating sheet is used as the electro-conductive sheet mentioned above and a corona ion is imparted to the insulating sheet by means of a charger installed inside the transfer drum, the force of adsorption exerted on the sensitive drum is sufficiently enhanced to effect uniform and highly efficient transfer. This method, however, has a disadvantage in that the device used for this method becomes complicated because the transfer charger must be fastened inside the transfer drum which by nature is operated by rotation.

As described above, the conventional transfer device is fated to entail the disadvantage that, for the establishment of a large contact width between the transfer roller and the sensitive drum, the transfer roller is inevitably pressed with great force against the sensitive drum to give rise to the phenomenon of partial loss of image. Particularly, in the case of the color recording device, since the transfer roller to be used is required to possess a large outside diameter and the force to be used for pressing the transfer roller is required to be large, it is extremely difficult to preclude the partial loss of image phenomenon.

The method which uses a transfer drum composed of a partially cleaved drum and an insulating sheet stretched across the cleft in the transfer drum and requires a charger to be installed inside the transfer drum is capable of reducing the pressure used for pressing and effecting uniform and highly efficient transfer. This method, however, is disadvantageous in respect that the device is complicated because it requires the transfer charger to be fastened inside the transfer drum destined to be operated by rotation.

OBJECT AND SUMMARY OF THE INVENTION

The problems of the prior art mentioned above motivated the development of the present invention. An object of the present invention is to provide a transfer device, having simplicity of construction, that effects transfer with high efficiency. The invention permits a reduction in the force exerted upon the sensitive drum as compared with the conventional device and gives a generous addition to the contact width with the sensitive drum, thereby producing transfer images of high quality free from the partial loss of image phenomenon.

In the present invention, an elastomer layer is relied on to produce flexibility and an electro-conductive layer to produce electrical properties for the sake of division of function. The device of the present invention, therefore, permits a notable addition to the range for selection of raw materials and ensures incorporation of extremely flexible transfer drum as compared with the conventional transfer device using electro-conductive rubber. For the elastomer layer, a soft spongy material such as foam polyurethane may be used. The contact can be obtained with a pressure of extremely small force by coating the surface of the elastomer layer with an electro-conductive sheet and using the surface of the electro-conductive sheet as a carrier for a transfer paper. Thus, the device of the present invention offers a solution to the problem of uneven transfer due to partial loss of image or poor contact of opposed surfaces and realizes highly efficient transfer.

The conventional transfer roller, for the purpose of maintaining the pressure exerted upon the sensitive drum at a fixed level, has been supported in place with a resilient material. In accordance with the present invention, however, the transfer roller is not required to be supported with any resilient material because the variation in the force of pressing due to a change in the contact width with the sensitive drum is extremely small. The device is only required to maintain the interaxial distance between the transfer drum and the sensitive drum at a fixed value. The lack of resilient material is a major factor contributing to simplification of mechanism.

The electro-conductive layer in the device of the present invention may be formed of a film or sheet possessing ample flexibility. As compared with the conventional electro-conductive rubber roller, the electro-conductive layer of the present invention using the film or sheet is advantageous in numerous respects, enjoying freedom from productional problems such as control of resistance and repeatability of the quality of flexibility and freedom from physical instability of materials due to deterioration by aging, for example.

DETAILED DESCRIPTION OF THE PREFERRED EMBODIMENT

Now, the embodiments of the present invention will be described in detail with reference to the accompanying drawings.

Figure 1:
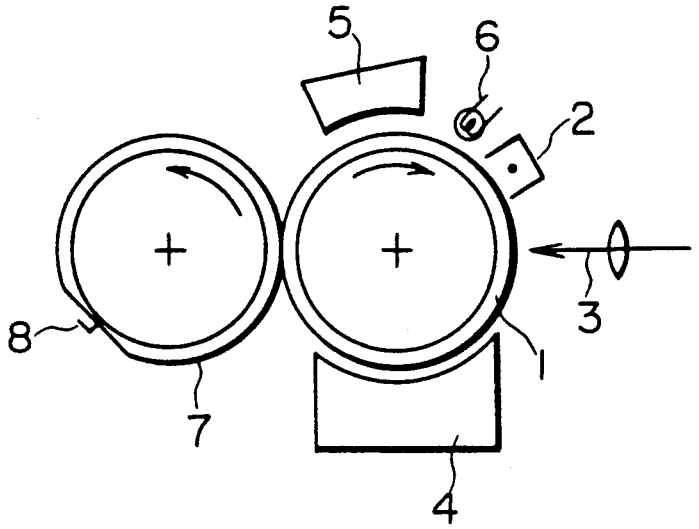
FIG. 1 is a cross section illustrating the essential part of a typical color copying device embodying the present invention.

FIG. 1 illustrates the transfer device of the present invention embodied in copying device. Specifically, this is a transfer device which uses a sensitive drum 1 as an image carrier and effects multiple transfer of a toner image formed on the sensitive drum 1 onto transfer papers to be supported one after another on the surface of a transfer drum 7.

The sensitive drum 1 is provided on the surface thereof with a selenium type photoconductive layer, for example. The sensitive drum 1 sequentially undergoes uniform electrification with an electric charger 2, exposure to an image in the first color with an electric exposure system 3, and development with a developer containing the first color among other plurality of developers 4 containing a plurality of toners of different colors, to form a toner image thereon. This color image is then transferred onto a transfer paper held in place with a gripper 8 on the transfer drum 7. By repeating this cycle of steps mentioned above, toner images of different colors are formed by multiple transfer on the transfer paper to give rise to a colored image.

Figure 2:
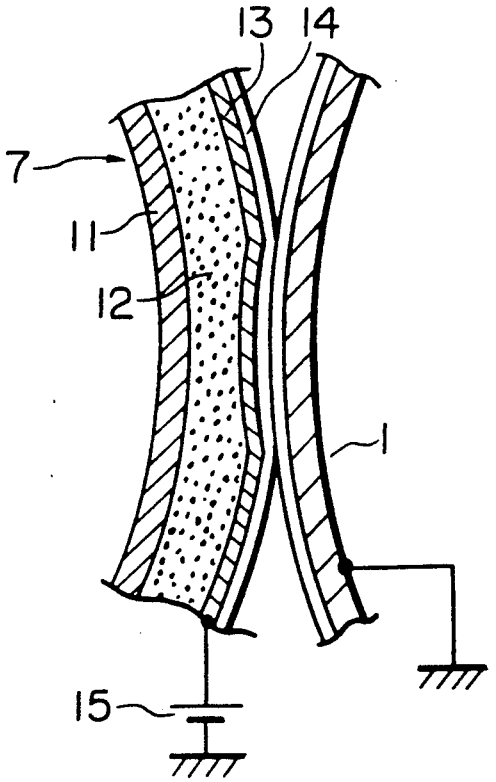
FIG. 2 is a cross section illustrating an essential part of a typical embodiment of the first aspect of the present invention.

FIG. 2 is a magnified cross section illustrating the contact parts of the transfer drum 7 and the sensitive drum 1.

The transfer drum suitably possesses a diameter in the range of 12 to 300 mm. It is constructed as follows.

This transfer drum is produced by applying an elastomer layer 12 of a flexible material, such as soft polyurethane foam, fast to the peripheral surface of a drum member 11 made of aluminum, for example, and wrapping around the surface of the elastomer layer 12 an electro-conductive sheet 13 prepared by dispersing electro-conductive carbon in polyethylene. On the surface of this transfer drum, a transfer paper 14 is supported in place with a gripper 8. The electro-conductive sheet 13 has the ends thereof fastened on the aluminum drum 11 with a fixing material (not shown). The electro-conductive sheet 13 is electrically connected to the aluminum drum 11. A power source 15 is connected to the aluminum drum and is allowed to apply transfer bias to the electro-conductive sheet 13.

The elastomer layer 12 is suitably made of a flexible material such as rubber or some other foaming soft material. A soft polyurethane foam possessing rigidity of not more than 100 kgf (as measured in accordance with JIS K-6401, as more fully described later on) is particularly suitable as the material for the elastomer layer 12. To be used advantageously, the foaming flexible material is desired to possess rigidity in the range of 1 to 100 kgf, preferably 5 to 40 kgf, per 25 mm, foaming cells in the range of 10 to 500 pieces, preferably 20 to 300 pieces, per 25 mm, density in the range of 10 to 700 $kg/m^3$, thickness in the range of 1 to 30 mm, preferably 2 to 10 mm, and residual compressive strain of not more than 10%, preferably not more than 8% (residual compressive strain was measured in accordance with JIS K-6401).

The elastomer layer 12 to be illustrated below by way of example is assumed to be made of an ester type flexible urethane foam possessing an average number of foam cells of 35 per 25 mm, density of 31 $kg/m^3$, and thickness of 5 mm. The electro-conductive sheet 13 suitably possesses flexibility and exhibits a value of specific resistance not exceeding $10^{12}$ Ω·cm, preferably falling in the range of $10^6$ to $10^{12}$ Ω·cm. An aluminum foil or an electro-conductive polyester sheet may be used. The electro-conductive sheet 13 to be illustrated below by way of example is assumed to possess a thickness of 70 um and specific resistance of $10^7$ Ω·cm.

The contact width of the transfer paper and the sensitive drum 1 suitably is in the range of 0.5 to 15 mm, preferably 2 to 10 mm. The pressure of contact between the transfer paper and the toner image formed on the sensitive drum 1 is desired to be in the range of 5 to 300 $g/cm^2$, preferably 10 to 80 $g/cm^2$.

Figure 3:
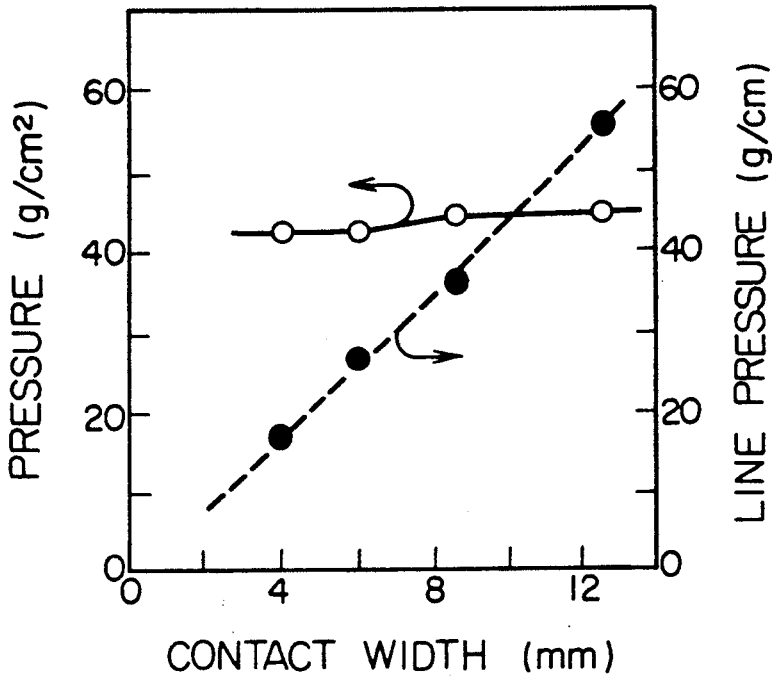
FIG. 3 is a graph showing the results of determination of the correlation between the contact width of the transfer drum with the sensitive drum and the pressure, performed on the device of the embodiment of FIG. 2.

FIG. 3 shows the results of determination of the relation between the pressure exerted by the transfer drum 7 across the transfer paper 14 placed on the surface thereof against the sensitive drum 1 and the contact width. It is clearly noted from the graph that the pressure per unit length, namely, the linear pressure (filled circles), in the axial direction of the drum increased with the growing contact width and the pressure per unit area (empty circles) was substantially constant, falling at a very low level of about 45 $g/cm^2$ over a range of contact width from 4 to 12 mm. In contrast, by the conventional method using a transfer drum coated with an electro-conductive rubber, it is difficult to obtain a contact width exceeding 4 mm. To obtain a contact width of 2 mm, the pressure was required to be in the range of 500 to 2,000 $g/cm^2$. This problem originates in the fundamental drawback that impartation of high flexibility to rubber without any sacrifice electro-conductivity is a difficult task. The present invention has solved this particular problem by severing the two functions.

Figure 4:
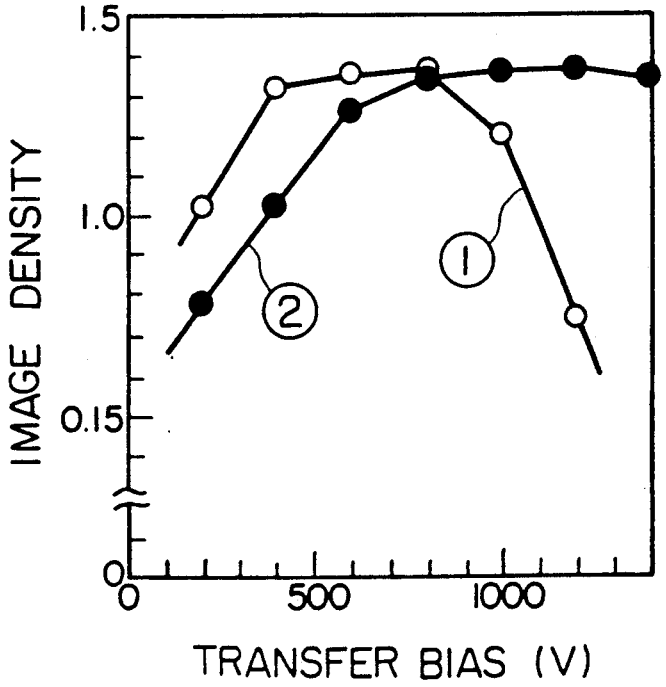
FIG. 4 is a graph showing the results of determination of the transfer properties of the embodiment.

The transfer device of the construction described above was experimentally operated for transferring a black toner image on a transfer paper, with the toner image thermally fixed and then tested for density of image. By this test, the transfer properties shown by the curve (1) in FIG. 4 were obtained. The transfer properties were very satisfactory over a wide range of transfer bias voltage from 400 to 800 V. The produced toner image showed absolutely no sign of the phenomenon of partial loss of image. High values of transfer efficiency exceeding 90% were exhibited over the aforementioned range of voltage. In the embodiment shown above, as the sensitive drum 1, a selenium type photoconductor drum 60 mm in outside diameter was used with the maximum surface potential at the position fixed at +600 V and the peripheral speed of rotation fixed at 100 mm/sec. The aluminum drum 11 in the transfer drum 7 had an outside diameter of 100 mm. The contact width between the sensitive drum 1 and the transfer paper 14 was fixed at 5 mm and the transfer drum was operated at a peripheral speed of rotation of 100 mm/sec, with the distance between the axis of rotation of the transfer drum 7 and the surface of the sensitive drum 1 taken as an imaginary radius of the transfer drum.

Figure 5:
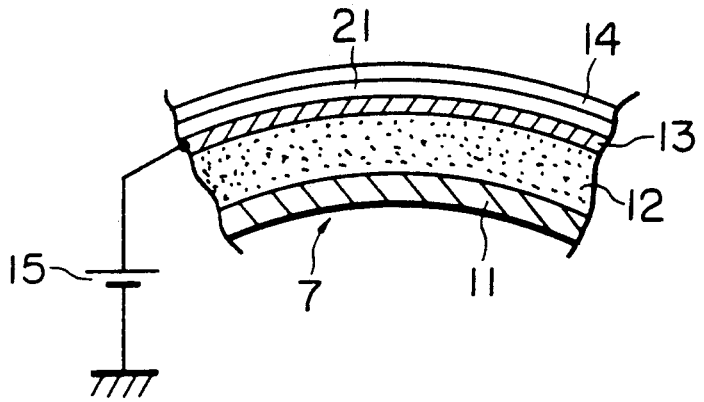
FIG. 5 is a cross section of the second aspect of the present invention.

FIG. 5 is a cross section illustrating an essential part of a typical embodiment of the second aspect of the present invention. A flexible polyurethane foam 12 was deposited on the peripheral surface of an aluminum drum 11 and a polyester film 21 having aluminum vacuum deposited on one side thereof to form an electro-conductive layer 13 was wrapped around the surface of the flexible polyurethane foam 12 with the polyester side thereof held on the exposed side. A transfer paper was supported on the surface of the polyester film 21. The aluminum-deposited polyester film had a thickness of 75 μm. To the aluminum layer, namely the electro-conductive layer 13 was connected a power source 15 through the medium of an electrode member (not shown). Thus, voltage generated by the power source could be applied to the electro-conductive layer 13. The device thus constructed was experimentally operated to effect transfer of a black toner with the contact width fixed at 5 mm. The toner image was then thermally fixed and tested for density. By this test, the properties of the curve (2) in FIG. 4 were obtained. Comparison of the characteristic curve (2) with the characteristic curve (1) obtained of the transfer device of FIG. 2 reveals that high bias voltage was required for obtaining high transfer efficiency, whereas the decline of density was small on the high potential side, indicating that the variation in the potential condition affects the transfer characteristic only slightly. The transfer image obtained in this case showed no sign of loss of image.

Figure 6:
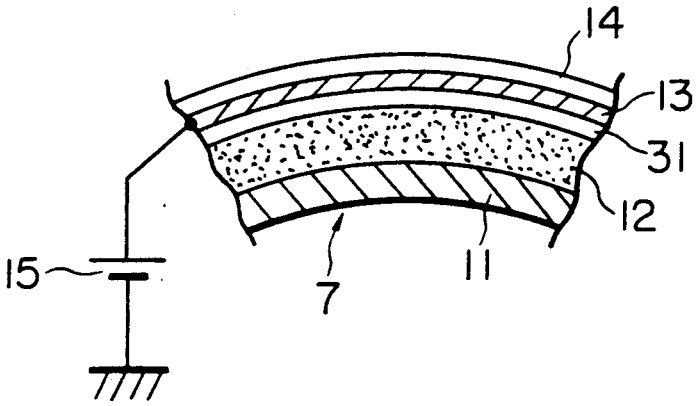
FIG. 6 is a cross section illustrating an essential part of a modification of the first aspect of the present invention.

FIG. 6 illustrates another typical embodiment of the first aspect of the present invention. An aluminum drum 7 and an elastomer layer 12 are identical to those used in the preceding embodiment. As an electro-conductive layer 13, however, there is used a film obtained by applying an electro-conductive resin layer 13 on a substrate 31. In this embodiment, the substrate 31 corresponds to part of the elastomer layer 12 in the device of the first aspect of the present invention.

As the material for the elastomer layer 12 in the devices of the embodiments of FIG. 2 and FIG. 5, varying grades of flexible urethane foam possessing different levels of rigidity were tested for correlation between rigidity and the phenomenon of partial loss of image. By this test, it was established that the phenomenon of partial loss of image occurred easily when the rigidity of flexible urethane foam exceeded 100 kg. The test of the flexible urethane foam for rigidity was carried out in accordance with JIS K-6401. To be specific, this test was carried out by placing a test piece 50 mm in thickness and about 30 cm in diameter flat on a base of a testing machine, superposing a pressing disc 200 mm in diameter on top of the test piece, pressing the test piece under a load of 0.5 kg, measuring the thickness of the test piece under this pressure, reporting the result of this measurement as the initial thickness, then depressing the pressing disc to a depth equalling 75% of the initial thickness of the test piece, immediately relieving the test piece of the load, again depressing the pressing disc to a depth equalling 25% of the initial thickness, allowing the test piece to stand at rest for 20 seconds, obtaining the scale reading of load at the end of this standing, and reporting the magnitude of load thus read out as the hardness.

The sensitive drum 1 was tested for correlation between the pressure exerted thereon and the transfer property. By this test, it was established that the phenomenon of partial loss of image could not occur so long as the pressure was not more than 300 g/cm$^2$.

As the material for the electro-conductive layer 13, various materials films and sheets possessing varying levels of resistance were examined. It was established by the test that the electro-conductive films or sheets ceased to function as an electrode and suffered from inferior transfer efficiency when the values of resistance exceeded $10^{12}$ Ω·cm. Particularly in the first aspect of the present invention, when the sensitive layer of the sensitive drum 1 sustains such surface flaws as pinholes electric discharge occurs between the electro-conductive layer 13, and the sensitive drum 1, with the possible result that the transfer bias voltage is lowered and the transfer is consequently impaired. Thus, the electro-conductive layer 13 to be used herein is desired to exhibit a value of resistance in the range of $10^6$ to $10^{12}$ Ω·cm. When a resistance of a value enough to curb the electric discharge mentioned above is inserted between the power source 15 and the electro-conductive layer 13, the electro-conductive layer 13 to be used herein may be tolerated to possess a value of resistance less than $10^6$ Ω·cm.

The embodiments have been described as ones applied to the multicolor copying device, This particular mode of embodiment is not critical. Optionally, the invention can be embodied in the ordinary monochromic electrophotographic process, of course. For example, the present invention may be embodied by forming a transfer roller possessing an outside diameter approximately in the range of 10 to 50 mm, opposing this transfer roller to a sensitive drum, nipping a transfer paper between their opposed surfaces, and advancing this transfer paper. In this device, transfer of a toner image can be advantageously obtained without use of any clipper.

As described above, the present invention realizes the division of the functions, flexibility and electro-conductivity, relying on an elastomer layer for the former function and an electro-conductive layer for the latter function. The present invention, therefore, allows very wide ranges for the selection of raw materials and permits construction of a very flexible transfer drum. The device of this invention generates a wide transfer contact width under very low pressure and produces transfer images of highly satisfactory quality with high efficiency.

What is claimed is:

1. A transfer drum for transferring a toner image on an image carrier onto a transfer material, comprising:

a rotatably supported drum member, an elastomer layer on a peripheral surface of the drum member, and an electroconductive layer on the surface of the elastomer layer; and an electrode for applying a bias voltage to the electroconductive layer.

2. A transfer drum for transferring a toner image on an image carrier onto a transfer material, comprising:

a rotatably supported drum member, an elastomer layer made of a foaming flexible material on a peripheral surface of the drum member, and an electroconductive layer on the surface of the elastomer layer, means for supporting the transfer material in place on the surface of the electroconductive layer; and an electrode for applying a bias voltage to the electroconductive layer.

3. A transfer drum for transferring a tone image on an image carrier onto a transfer material, comprising:

a rotatably supported drum member;

an elastomer layer on a peripheral surface of said drum member;

an electro-conductive layer on the surface of said elastomer layer;

transfer material supporting means adapted to support said transfer material on the surface of said electro-conductive layer; and an electrode for applying a bias voltage to said electro-conductive layer.

4. A transfer drum for transferring a toner image on an image carrier onto a transfer material, comprising:

a rotatably supported drum member, an elastomer layer made of a foaming flexible material on a peripheral surface of the drum member, an electroconductive layer on the surface of the elastomer layer, and an insulating layer on the surface of the electroconductive layer, means for supporting the transfer material in place on the surface of the insulating layer; and an electrode for applying a bias voltage to the electroconductive layer, wherein the transfer drum is disposed in such a manner that the transfer material is in contact with the toner image on the image carrier under a pressure of not more than 300 g/cm$^2$.

5. A transfer device for transferring an image onto a transfer material, comprising:

an image carrier;

a transfer drum including a rotatably supported drum member, an elastomer layer on a peripheral surface of the drum member, and an electroconductive layer on the surface of the elastomer layer, and means for contacting the transfer material with a toner image on the image carrier; and voltage application means for applying a bias voltage to the electroconductive layer.

6. A transfer device for transferring an image onto a transfer material, comprising: an image carrier; a rotatably supported drum member; an elastomer layer on a peripheral surface of said drum member; an electro-conductive layer on the surface of said elastomer layer; transfer material supporting means adapted to support said transfer material on the surface of said electro-conductive layer; and voltage application means for applying a bias voltage to said electro-conductive layer; and means for contacting said transfer material with a toner image on said image carrier.

7. The transfer device of claim 6, wherein said elastomer layer comprises a foaming flexible material.

8. The transfer device of claim 7 wherein said foaming flexible material is a flexible urethane foam possessing rigidity of not more than 100 kg.

9. A transfer device for transferring an image onto a transfer material, comprising: an image carrier; a rotatable supported drum member; an elastomer layer on a peripheral surface of said drum member; an electro-conductive layer on the surface of said elastomer layer; and insulator layer on the surface of said electro-conductive layer; transfer material supporting means adapted to support said transfer material on the surface of said insulator layer; and voltage application means for applying a bias voltage to said electro-conductive layer; means for contacting said transfer material with a toner image on said image carrier.

10. The transfer device of claim 9, wherein said elastomer layer comprises a foaming flexible material.

11. The transfer device of claim 10, wherein said foaming flexible material is a flexible urethane foam possessing rigidity of not more than 100 kg.

12. The transfer device of claim 11 wherein the electro conductive layer possesses a value of resistance of not more than $10^{12}$ Ω·cm.

13. The transfer device of claims 9 or 10 wherein said electro-conductive layer possesses a value of resistance of not more than $10^{12}$ Ω·cm.

14. The transfer device of claim 13 wherein the means for contacting includes means for contacting the transfer material with the toner image on the image carrier under a pressure not exceeding 300 g/cm$^2$.

15. The transfer device of claims 9 or 10 wherein the means for contacting includes means for contacting said transfer material with the toner image on said image carrier under a pressure not exceeding 300 g/cm$^2$.

16. A transfer device for transferring an image onto a transfer material, comprising:

an image carrier;

a transfer drum including a rotatably supported drum member, an elastomer layer made of a foaming flexible material on a peripheral surface of the drum member, and an electroconductive layer on the surface of the elastomer layer, means for supporting the transfer material in place on the surface of the electroconductive layer, and means for contacting the transfer material with a toner image on the image carrier with a pressure not exceeding 300 g/cm$^2$; and voltage application means for applying a bias voltage to the electroconductive layer.

17. The transfer device of claims 5, 6, or 16 wherein the means for contacting includes means for contacting said transfer material with the toner image on said image carrier under a pressure not exceeding 300 g/cm$^2$.

18. A transfer device for transferring an image onto a transfer material, comprising:

an image carrier;

a transfer drum including a rotatably supported drum member, an elastomer layer made of a foaming flexible material on a peripheral surface of the drum member, an electroconductive layer on the surface of the elastomer layer, and an insulating layer on the surface of the electroconductive layer, means for supporting the transfer material in place on the surface of the insulating layer; and voltage application means for applying a bias voltage to the electroconductive layer, wherein the transfer drum is disposed in such a manner that the transfer material is in contact with the toner image on the image carrier under a pressure of not more than 300 g/cm$^2$.

19. The transfer device of claims 5, 6, 9, 16 or 18 wherein the voltage application means is an electrode.

20. The transfer device of claim 19 wherein the electro-conductive layer possesses a value of resistance of not more than $10^{12}$ Ω·cm.

21. The transfer device of claims 1, 2, 3, 4, 5, 6, 7, 16, or 18 said electro-conductive layer possesses a value of resistance of not more than $10^{12}$ Ω·cm.

* * * * *